US008079330B2

(12) United States Patent
Maehara et al.

(10) Patent No.: US 8,079,330 B2
(45) Date of Patent: Dec. 20, 2011

(54) MULTICYLINDER ENGINE FOR A VEHICLE, AND VEHICLE INCORPORATING SAME

(75) Inventors: Hayato Maehara, Saitama (JP); Shinji Saito, Saitama (JP); Takaaki Tsukui, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 938 days.

(21) Appl. No.: 12/079,375

(22) Filed: Mar. 26, 2008

(65) Prior Publication Data

US 2008/0236520 A1 Oct. 2, 2008

(30) Foreign Application Priority Data

Mar. 30, 2007 (JP) ..... 2007-095703

(51) Int. Cl.
*F02B 75/18* (2006.01)

(52) U.S. Cl. ..... 123/52.1; 123/58.1; 123/188.1; 123/188.2; 123/41.31; 123/41.41

(58) Field of Classification Search ..... 123/52.1, 123/58.1, 188.1, 188.2, 41.3, 41.31, 41.41
See application file for complete search history.

(56) References Cited

U.S. PATENT DOCUMENTS

| | | | | |
|---|---|---|---|---|
| 5,069,192 | A * | 12/1991 | Matsumoto et al. | 123/572 |
| 5,347,967 | A * | 9/1994 | Todero et al. | 123/317 |
| 5,601,057 | A * | 2/1997 | Treyz et al. | 123/90.16 |
| 5,809,955 | A * | 9/1998 | Murata et al. | 123/90.17 |
| 6,293,244 | B1 * | 9/2001 | Mullins et al. | 123/196 R |
| 6,318,316 | B1 * | 11/2001 | Tsukui et al. | 123/90.16 |
| 6,443,136 | B1 * | 9/2002 | Suganami et al. | 123/572 |
| 6,981,473 | B2 * | 1/2006 | Gunji et al. | 123/41.82 R |
| 7,089,906 | B2 * | 8/2006 | Tsukui et al. | 123/198 F |
| 7,188,600 | B1 | 3/2007 | Maehara et al. | |
| 7,210,454 | B2 | 5/2007 | Maehara et al. | |
| 7,523,733 | B2 * | 4/2009 | Moore | 123/188.2 |
| 7,600,491 | B2 * | 10/2009 | Negoro et al. | 123/41.54 |
| 2007/0235013 | A1 * | 10/2007 | Maekawa | 123/635 |
| 2007/0272194 | A1 * | 11/2007 | Hoi et al. | 123/196 R |

FOREIGN PATENT DOCUMENTS

| | | |
|---|---|---|
| JP | 2000-205038 | 7/2000 |
| JP | 2000-303850 | 10/2000 |
| JP | 2002-180812 | 6/2002 |
| JP | 2005-090463 | 4/2005 |
| JP | 2006-283578 | 10/2006 |

OTHER PUBLICATIONS

Machine Translation of JP 2005-090463.*

* cited by examiner

*Primary Examiner* — Michael Cuff
*Assistant Examiner* — Long T Tran
(74) *Attorney, Agent, or Firm* — Carrier Blackman & Associates, P.C.; William D. Blackman; Joseph P. Carrier

(57) ABSTRACT

A multicylinder engine for a motorcycle includes a valve actuation mechanism having a hydraulically-operated valve pausing mechanism for holding at least one of an intake valve and an exhaust valve of selected cylinders in a suspended state. The valve actuation mechanism operates the intake valve and the exhaust valve, and controls flow of oil through an oil passage which introduces working oil to the valve pausing mechanism from a hydraulic-pressure control device. Air-bleeding holes are formed in the cylinder head. The air-bleeding holes are fluidly connected with portions of the oil passages that are located at a highest level in the oil passages while the motorcycle is parked in an inclined state with its side stand down.

20 Claims, 8 Drawing Sheets

MULTICYLINDER ENGINE FOR A VEHICLE, AND VEHICLE INCORPORATING SAME

CROSS-REFERENCE TO RELATED APPLICATIONS

The present application claims priority under 35 USC §119 based on Japanese patent application No. 2007-095703, filed on Mar. 30, 2007. The entire subject matter of this priority document is incorporated by reference herein.

BACKGROUND OF THE INVENTION

1. Field of the Invention

The present invention relates to a multicylinder engine for a vehicle such as a motorcycle. More particularly, the present invention relates to a motorcycle engine having a plurality of cylinders and a hydraulically-operated valve pausing mechanism, and which enables air bleeding of an oil passage of the valve pausing mechanism when the motorcycle is normally parked in an inclined state with its side stand down.

2. Description of the Background Art

There are a number of known multicylinder engines for a motorcycle in which the hydraulic pressure of a valve pausing mechanism disposed in a valve actuation mechanism is controlled to suspend an operation of at least one of an intake valve and an exhaust valve of selected one or more of the plurality of cylinders such that the at least one of the intake and exhaust valves is held closed, whereby an operation of the selected cylinders is suspended depending on the operational state of the engine.

An example of such a known multicylinder engine for a motorcycle is disclosed in the Japanese Patent Document number JP-A 2005-90463.

In such a known multicylinder engine for a motorcycle, as disclosed in the Japanese Patent Document number JP-A 2005-90463, in order to maintain operational characteristics of the valve pausing mechanism, air is removed from the oil passage. Hence, it is desired to carefully consider where to form an air-bleeding hole in the cylinder head to enable smooth and effective removal of air from the oil passage.

The present invention has been developed in view of the above-described situations. Accordingly, it is an object of the present invention to provide a multicylinder engine for a motorcycle which enables air bleeding of an oil passage even when the motorcycle is parked in an inclined state with its side stand down.

SUMMARY OF THE INVENTION

In order to achieve the above object, a first aspect of the present invention provides a multicylinder engine having a plurality of cylinders, a cylinder head having an oil passage and an air-bleeding hole formed therein, the air-bleeding hole being operatively connected with the oil passage, an intake valve and an exhaust valve disposed in the cylinder head for each of the plurality of cylinders, the intake valve and the exhaust valve being openable and closable during engine operation, a valve actuation mechanism having a hydraulically-operated valve pausing mechanism (also referred as valve pausing device) configured to hold at least one of the intake valve and the exhaust valve of selective one or more of said plurality of cylinders in a suspended state, wherein the at least one of the intake valve and the exhaust valve is held closed, depending on the operational state of the engine, and a hydraulic-pressure control device for controlling hydraulic pressure of the valve pausing mechanism.

The valve actuation mechanism controls operation of the intake valve and the exhaust vale, and also controls the flow of oil in the oil passage for introducing working oil to the valve pausing mechanism from the hydraulic-pressure control device controlling the hydraulic pressure of the valve pausing mechanism. The air-bleeding hole formed in the cylinder head communicates with a portion of the oil passage located at a highest level in the oil passage when the motorcycle is parked in an inclined state using its side parking stand.

In a second aspect of the present invention, in addition to the first aspect, the invention is characterized in that the air-bleeding hole formed in the cylinder head is in communication with an end portion of the oil passage.

In a third aspect of the present invention, in addition to one of the first aspect and the second aspect, the multicylinder engine further includes a lifter hole plate having an inlet hole, the oil passage and the air-bleeding hole formed therein. The inlet hole introduces the working oil from the hydraulic-pressure control device into the oil passage. The inlet hole fluidly communicates with one of two opposite end portions of the oil passage and the air-bleeding hole fluidly communicates with the other end portion of the oil passage.

EFFECTS OF THE INVENTION

According to the first aspect of the present invention, the air-bleeding hole is in communication with the portion of the oil passage introducing the working oil from the hydraulic-pressure control device to the valve pausing mechanism. The portion of the oil passage, which fluidly communicates with the air-bleeding hole, is located at the highest level in the oil passage when the motorcycle is a parked in the inclined state with its side parking stand moved down. Hence, such arrangement, i.e., the air-bleeding hole with the portion of the oil passage of oil passage being located at the highest level enables smooth and effective air bleeding of the oil passage in a state even when the motorcycle is parked.

According to the second aspect of the present invention, the end portion of the oil passage, where air tends to accumulate, is in communication with the air-bleeding hole, thereby enabling efficient air bleeding from the oil passage. Such aspect of the present invention is advantageous over an arrangement where an air-bleeding hole is in communication with a middle portion of an oil passage, in which air introduced into the oil passage tends to flow with the oil thereby affecting performance of the valve pausing mechanism.

According to the third aspect of the present invention, the air introduced in the oil passage from one of two end portions of the oil passage is accumulated in the other end portion of the oil passage, wherein air-bleeding hole is disposed, to more efficiently performing the air bleeding of from the oil passage.

For a more complete understanding of the present invention, the reader is referred to the following detailed description section, which should be read in conjunction with the accompanying drawings.

DETAILED DESCRIPTION OF ILLUSTRATIVE EMBODIMENTS

It should be understood that only structures considered necessary for illustrating selected embodiments of the present invention are described herein. Other conventional structures, and those of ancillary and auxiliary components of the system, will be known and understood by those skilled in the art.

Hereinafter, described is an illustrative mode for carrying out the present invention, based on an illustrative embodiment of the invention shown in the accompanying drawings.

Figure 1:
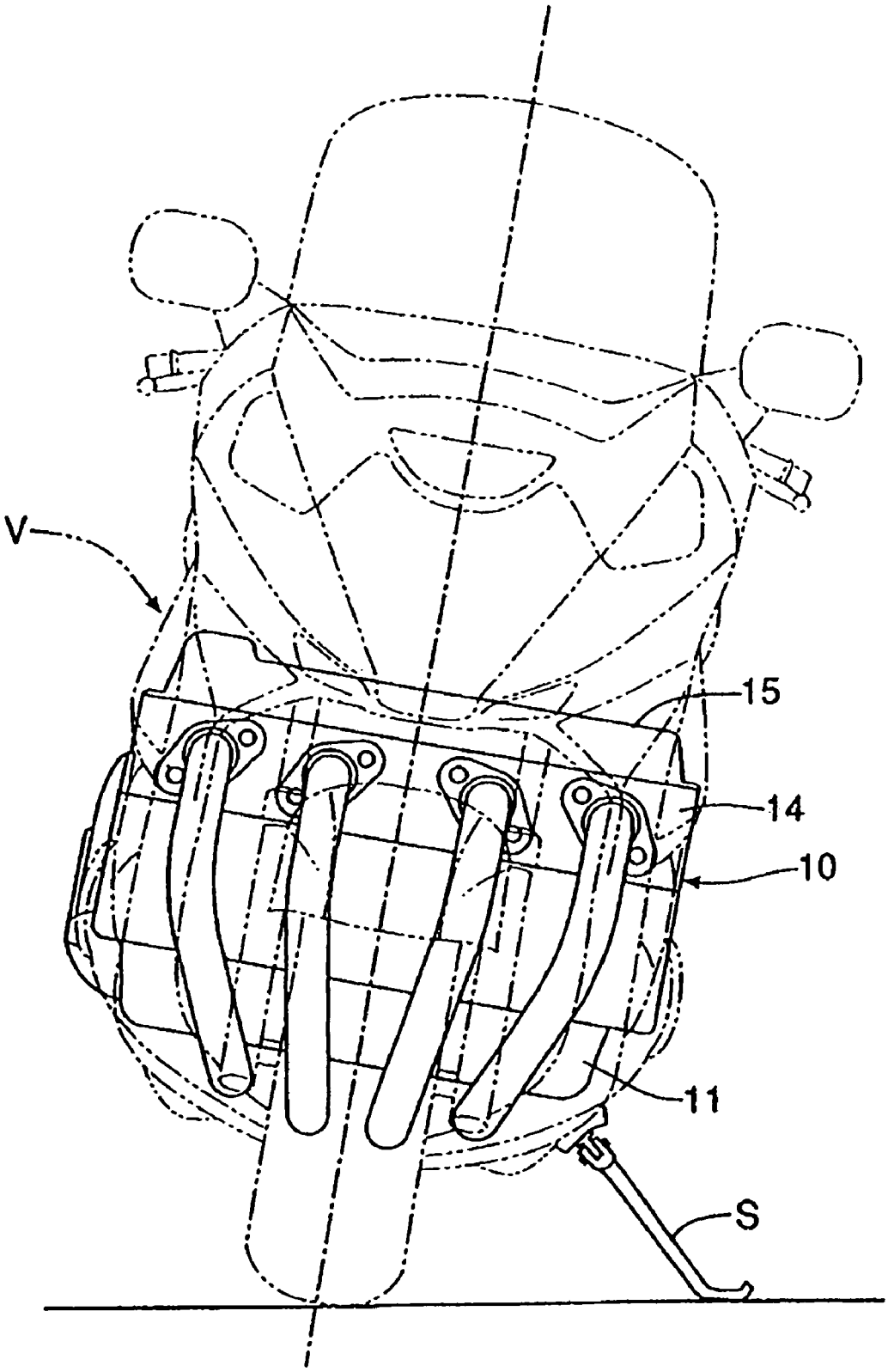
FIG. 1 is a front view of an engine installed in a motorcycle parked in an inclined state.
Figure 2:
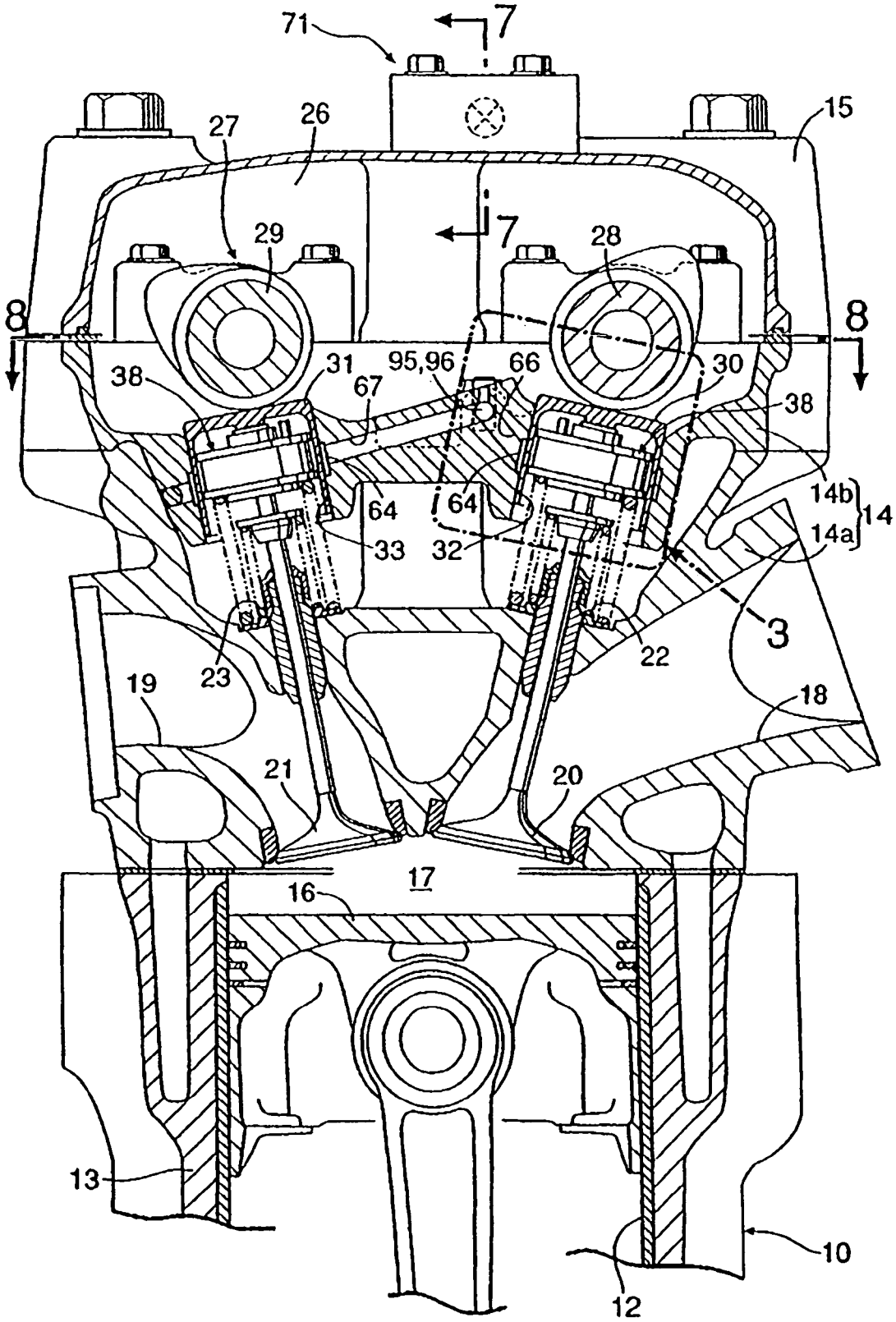
FIG. 2 is a vertical cross-sectional view of a relevant part of the engine taken along a line 2-2 in FIG. 8.
Figure 3:
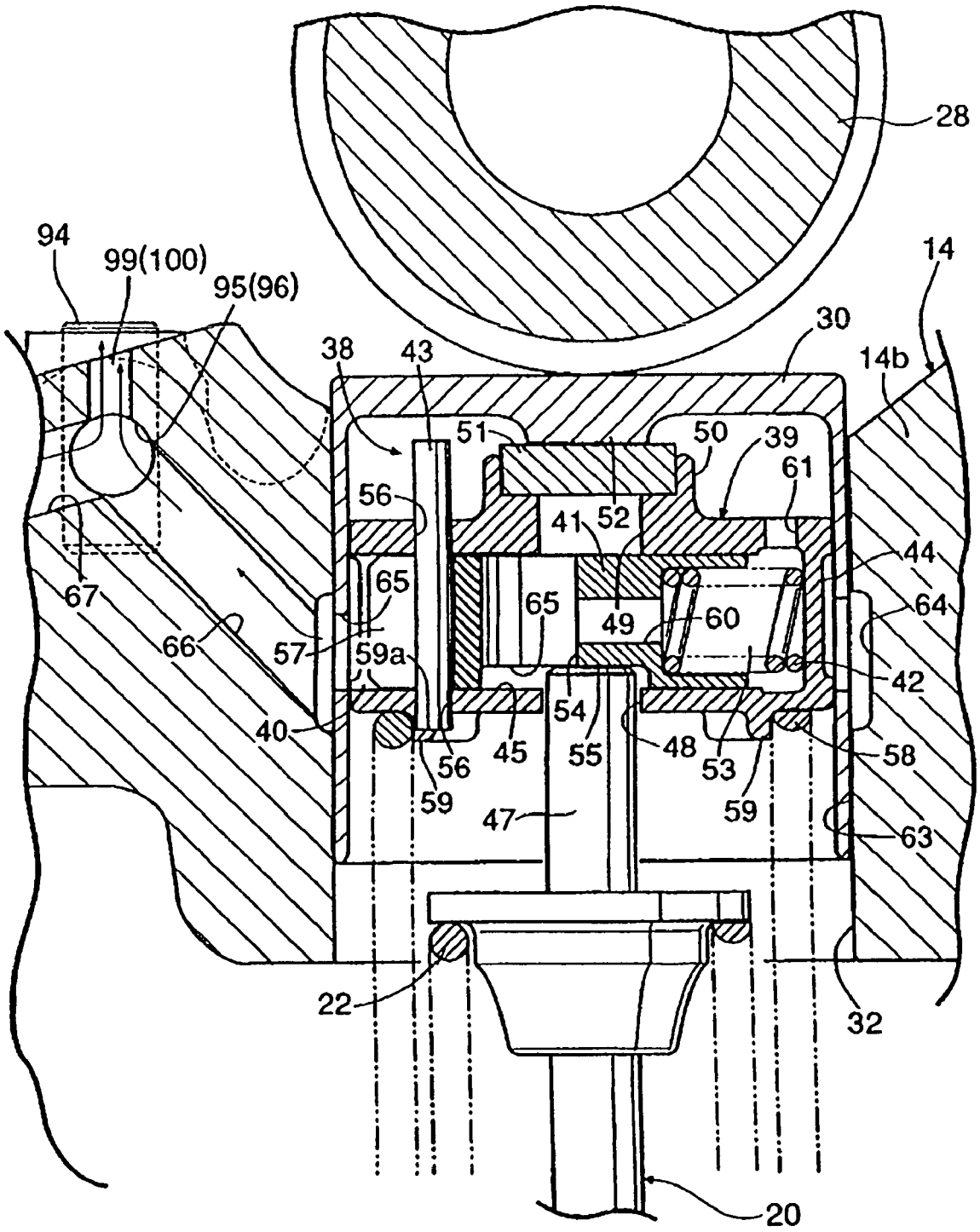
FIG. 3 is an enlarged view of a portion of the engine indicated by an arrow 3 in FIG. 2.

FIGS. 1-9 show an illustrative embodiment of the present invention. FIG. 1 is a front view of an engine body installed in a motorcycle shown in a parked state with its side parking stand. FIG. 2 is a vertical cross-sectional view of a relevant portion of the engine body and is a cross-sectional view taken along a line 2-2 in FIG. 8. FIG. 3 is an enlarged view of a portion indicated by an arrow 3 in FIG. 2.

Figure 4:
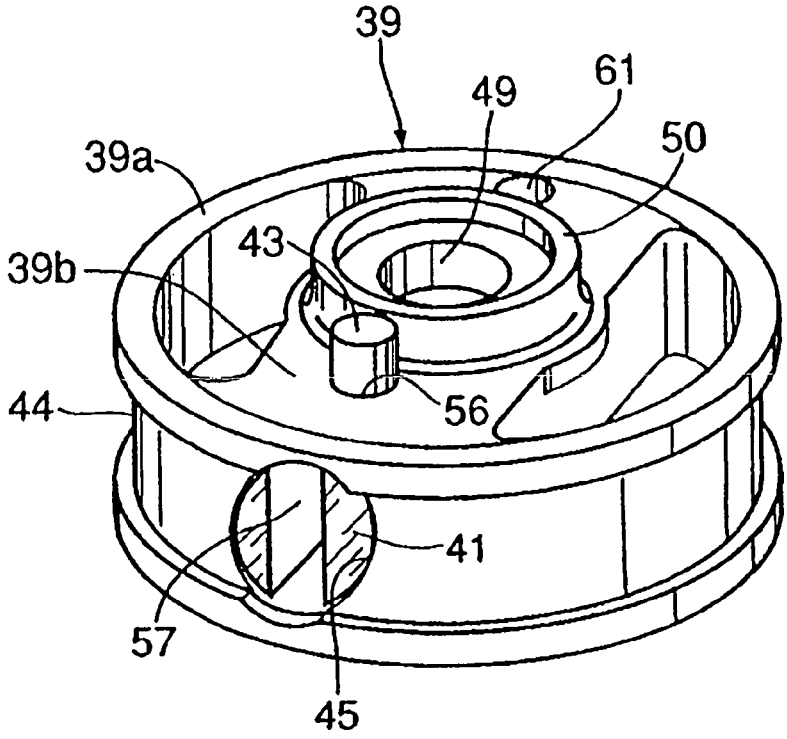
FIG. 4 is a perspective view of a pin holder as seen from an upper side.
Figure 5:
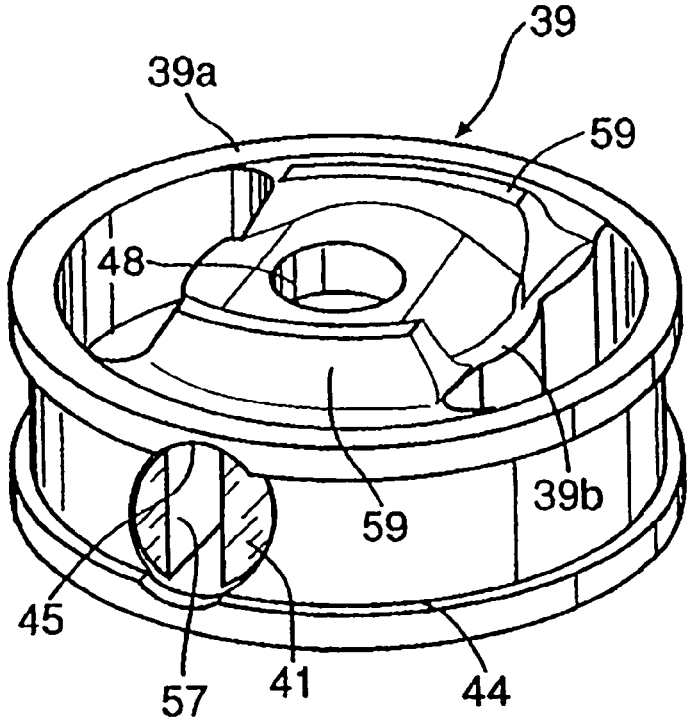
FIG. 5 is a perspective view of the pin holder as seen from a lower side.
Figure 6:
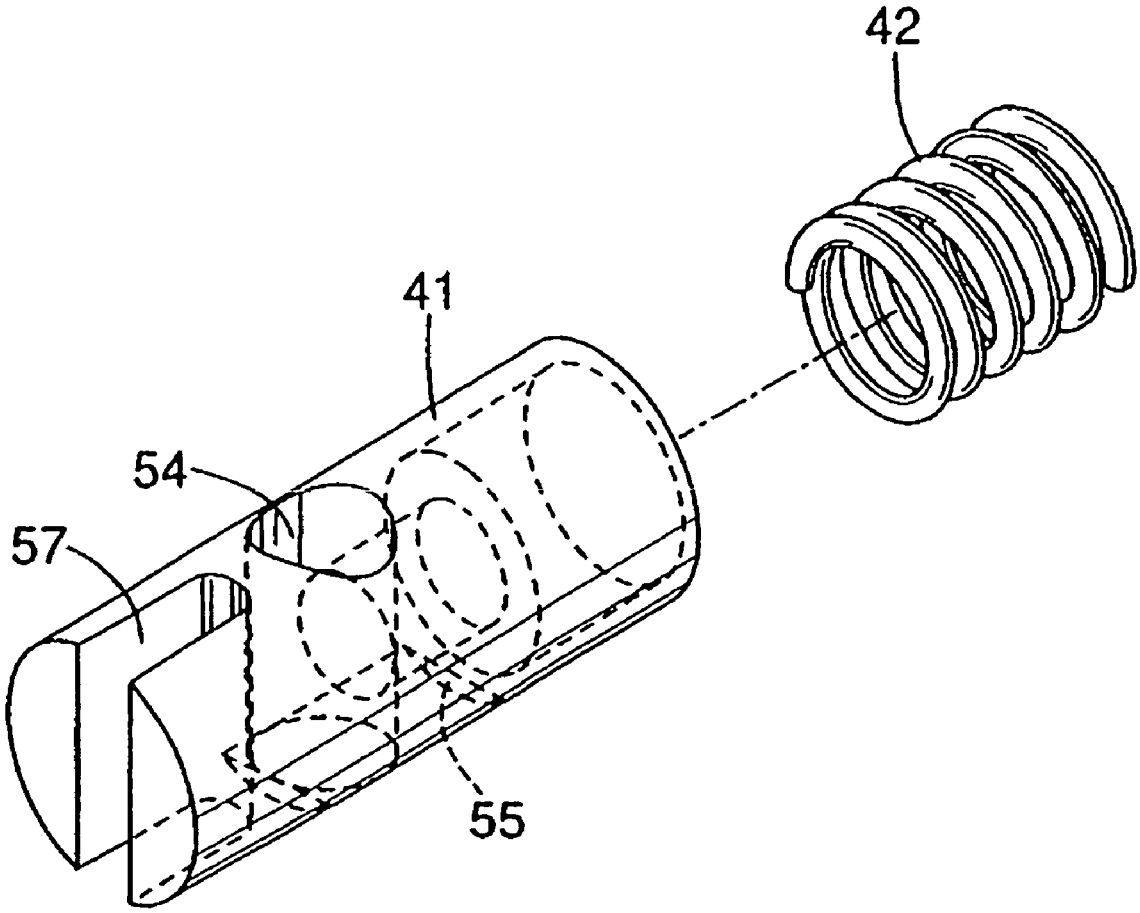
FIG. 6 is a perspective view of a slide pin and a return spring.
Figure 7:
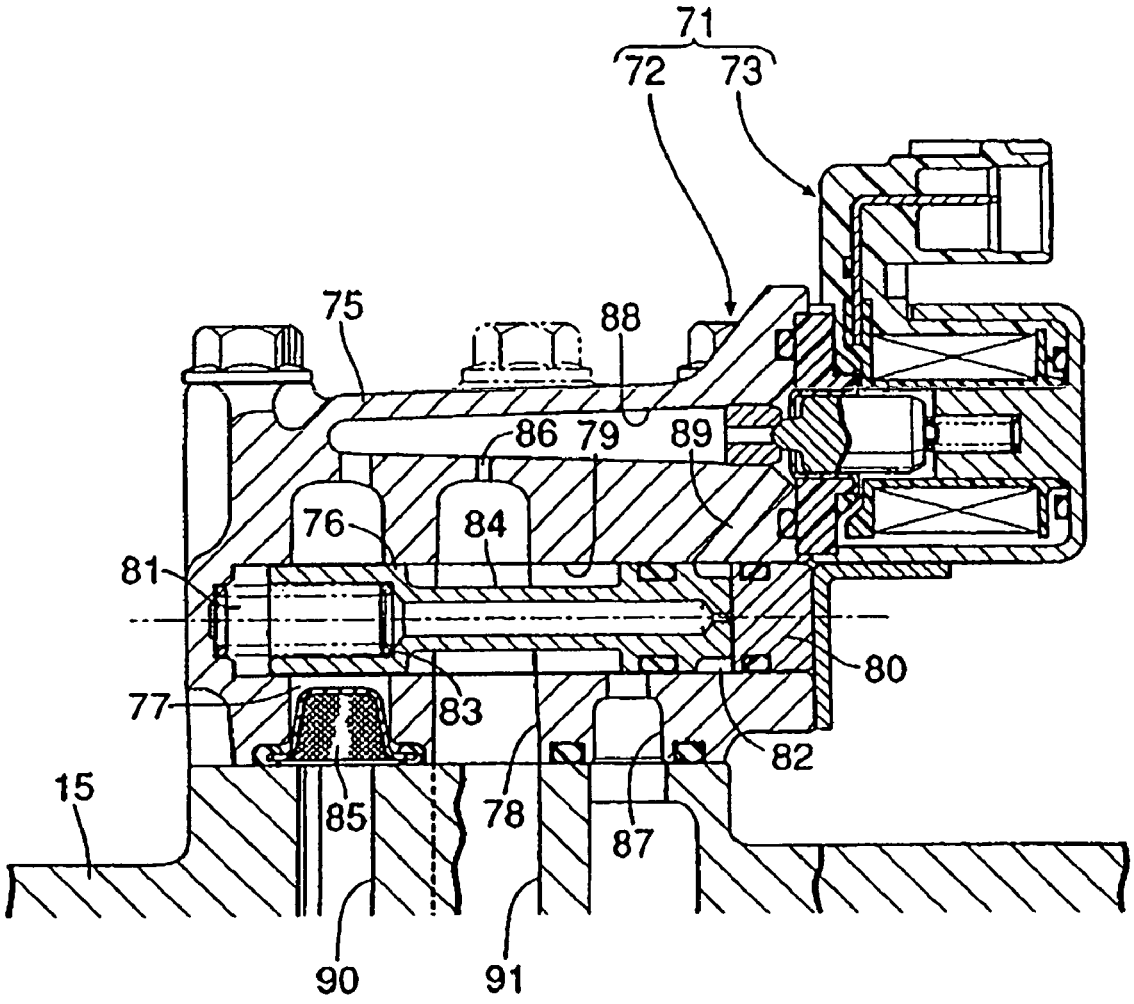
FIG. 7 is a cross-sectional view taken along a line 7-7 in FIG. 2.
Figure 8:
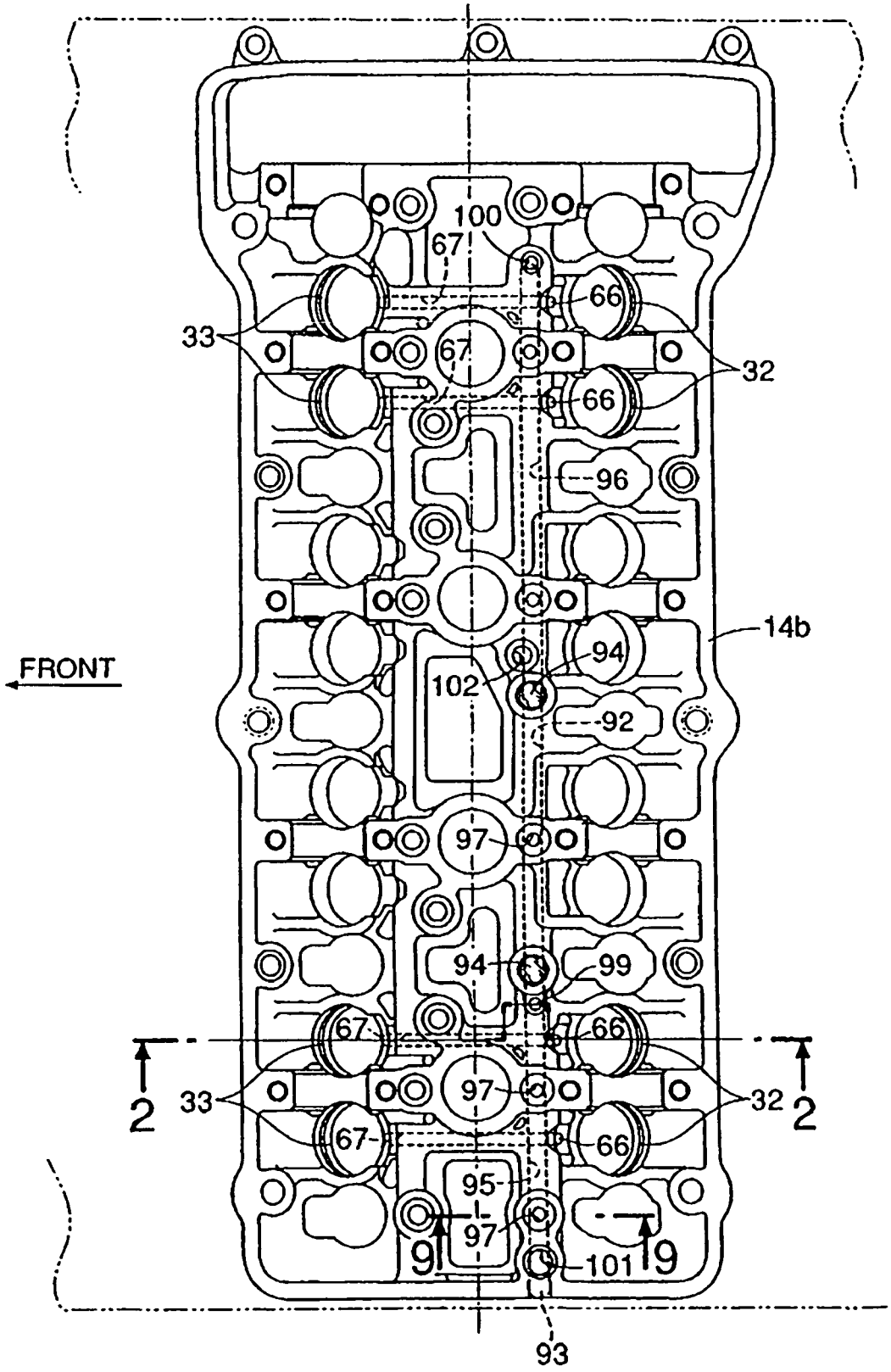
FIG. 8 is a plan view of a lifter hole plate as seen from a position of and in a direction indicated by arrows 8-8 in FIG. 2.
Figure 9:
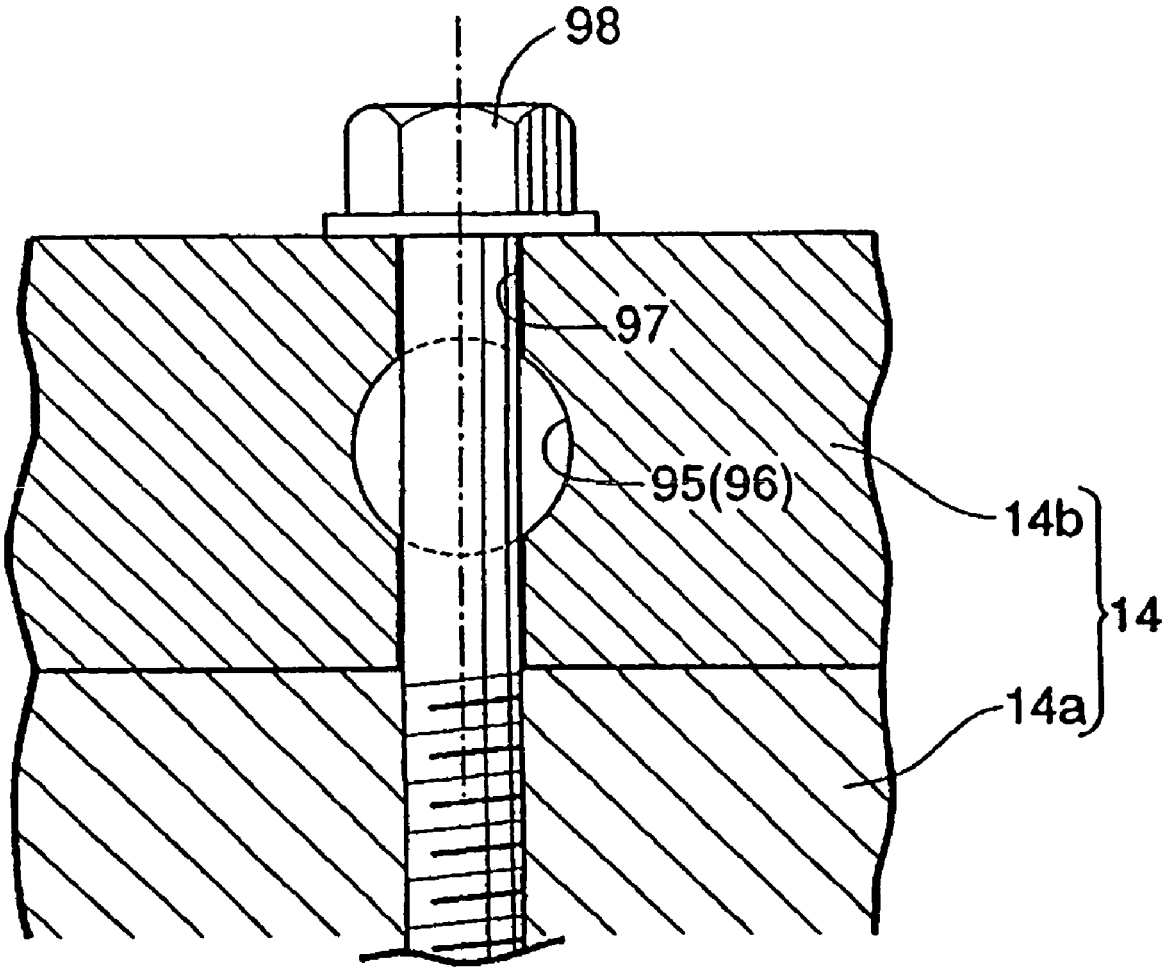
FIG. 9 is a cross-sectional view of a cylinder head taken along a line 9-9 in FIG. 8.

FIG. 4 is a perspective view of a pin holder as seen from an upper side. FIG. 5 is a perspective view of the pin holder as seen from a lower side. FIG. 6 is a perspective view of a slide pin and a return spring. FIG. 7 is a cross-sectional view taken along a line 7-7 in FIG. 2. FIG. 8 is a plan view of a lifter hole plate as seen from a position of and in a direction indicated by arrows 8-8 in FIG. 2. FIG. 9 is a cross-sectional view of a cylinder head taken along a line 9-9 in FIG. 8.

Referring first to FIG. 1, an engine body 10 of a multicylinder engine, e.g., an inline four-cylinder engine, is installed in a motorcycle V such that cylinders are arranged in a transverse direction of the motorcycle V. In a state where the motorcycle V is parked with its side stand S down, the motorcycle V leans to the left, and the engine body 10 accordingly leans to the left with its left end portion with respect to the transverse direction being lowered.

In another embodiment, where the motorcycle V is parked with its side stand S (located on right side) down, the motorcycle V leans to the right, and the engine body 10 accordingly leans to the right with its right end portion with respect to the transverse direction being lowered.

Referring to FIGS. 1-2, the engine body 10 includes a crankcase 11, a cylinder block 13 having four cylinder bores 12 corresponding to four cylinders arranged in the transverse direction of the motorcycle and connected to the crankcase 11, a cylinder head 14 connected to the cylinder block 13, and a head cover 15 connected to the cylinder head 14. The cylinder head 14 includes a head body 14*a* connected to the cylinder block 13, and a lifter hole plate 14*b* secured to the head body 14*a*. The head cover 15 is connected to the lifter hole plate 14*b*.

In the cylinder bores 12, respective pistons 16 are slidably fitted. A plurality of combustion chambers 17 are formed for the respective cylinders between the cylinder block 13 and the head body 14*a* of the cylinder head 14, such that top portions of the pistons 16 face the combustion chambers 17.

Four intake ports 18 and four exhaust ports 19 that communicate with the respective combustion chambers 17 are disposed in the head body 14*a* of the cylinder head 14, such that the intake ports 18 open in a rear surface (a right-hand surface as seen in FIG. 2) of the head body 14*a* that faces the rear side of the motorcycle V, and the exhaust ports 19 open in a front surface (a left-hand surface as seen in FIG. 2) of the head body 14*a* that faces the front side of the motorcycle V.

Further, a pair of intake valves 20 and a pair of exhaust valves 21 for each of the cylinders are disposed in the head body 14*a* of the cylinder head 14 such that the intake valves 20 are operable, i.e., openable and closable to communicate, and disconnect the intake ports 18 with and from the respective combustion chambers 17, and the exhaust valves 21 are operable, i.e., openable and closable to communicate, and disconnect the exhaust ports 19 with and from the respective combustion chambers 17. The intake valves 20 and the exhaust valves 21 are respectively biased by valve springs 22 and 23 in a valve closing direction.

The intake valves 20 and the exhaust valves 21 are driven, i.e., opened and closed by a valve actuation mechanism 27 disposed in a valve chamber 26 formed between the cylinder head 14 and the head cover 15. The valve actuation mechanism 27 has intake and exhaust camshafts 28, 29 disposed parallel to each other above the intake valves 20 and the exhaust valves 21 respectively.

The valve actuation mechanism also has intake valve lifters 30 having bottomed cylindrical members slidably fitted in the cylinder head 14 between the intake camshaft 28 and the intake valves 20 so as to reciprocate in accordance with rotation of the intake camshaft 28, and exhaust valve lifters 31 having bottomed cylindrical members slidably fitted in the cylinder head 14 between the exhaust camshaft 29 and the exhaust valves 21 so as to be reciprocate in accordance with rotation of the exhaust camshaft 29.

The intake valve lifters 30 and the exhaust valve lifters 31 are slidably fitted in support holes 32, 33 formed in the lifter hole plate 14*b* of the cylinder head 14.

Among the four cylinders arranged in a line, two cylinders at two opposite ends of the line can be held in a cylinder pausing state depending on the operational state of the engine, by holding at least one of the intake valves 20 and the exhaust valves 21 in a suspended state where operations of the at least one of the intake valves 20 and the exhaust valves 21 are suspended.

In this embodiment, in the cylinder pausing state, the valve actuation mechanism 27 holds both the intake valves 20 and the exhaust valves 21 corresponding to the two cylinders at the two ends of the line of arrangement of the cylinders in a closed state, i.e., in the suspended state.

The engine body 10 of the present invention includes a plurality of hydraulically-operated valve pausing mechanisms 38 (also referred as hydraulically-operated valve pausing devices 38)—for holding the intake valves 20 and the exhaust valves 21 in the suspended state with the intake valves 20 and the exhaust valves 21 being held closed—disposed in intake valve lifters 30 and exhaust valve lifters 31 of the valve actuation mechanism 27.

As shown in FIG. 3, the valve pausing mechanism (device) 38 is disposed in the intake valve lifter 30. The valve pausing mechanism 38 includes a pin holder 39, a slide pin 41, a return spring 42, and a stopper pin 43.

The pin holder 39 is slidably fitted in the intake valve lifter 30. The slide pin 41 is slidably fitted in the pin holder 39 such that a hydraulic chamber 40 is formed between an inner surface of the intake valve lifter 30 and the slide pin 41. The return spring 42 is disposed between the slide pin 41 and the pin holder 39 and exerts a spring force on the slide pin 41 in a direction so as to decrease an inner volume of the hydraulic chamber 40. The stopper pin 43 is disposed between the slide pin 41 and the pin holder 39 such that the stopper pin 43 limits a movement of the slide pin 41 in the direction to decrease the inner volume of the hydraulic chamber 40 while inhibiting rotation of the slide pin 41 around its own axis.

Referring further to FIGS. 4 and 5, the pin holder 39 includes a ring portion 39*a* slidably fitted in the intake valve lifter 30, and a bridge portion 39*b* extending along a diameter line of the ring portion 39*a* to connect two points on an inner circumferential surface of the ring portion 39*a*. A pair of lightening holes is formed between the inner circumferential surface of the ring portion 39*a* and two opposite side surfaces of the bridge portion 39*b* to reduce the weight of the pin holder 39.

On an outer circumferential surface of the pin holder 39, that is, on an outer circumferential surface of the ring portion 39*a*, an annular groove 44 is formed. A bottomed sliding hole 45 is formed in the bridge portion 39*b* of the pin holder 39 having an axis parallel to the diameter line of the ring portion 39*a*, that is, perpendicular to an axis of the intake valve lifter 30. The sliding hole 45 has an open end at one of two opposite ends thereof in the annular groove 44, and the other end of the sliding hole 45 is closed.

An insertion hole 48 is formed at a lower side of a central portion of the bridge portion 39*b*. An inner end of the insertion hole 48 opens into the sliding hole 45. An end portion of a valve stem 47 of the intake valve 20 is biased into the insertion hole 48 by the valve spring 22 in the valve closing direction. At an upper side of the central portion of the bridge portion 39*b*, an extension hole 49 is formed coaxially with the insertion hole 48 such that the end portion of the valve stem 47 can be accommodated in the extension hole 49. The sliding hole 45 is located (sandwiched) between the insertion hole 48 and the extension hole 49.

A cylindrical accommodation portion 50 coaxial with the extension hole 49 is integrally formed at a portion of the bridge portion 39*b* of the pin holder 39 opposed to a closed end of the intake valve lifter 30. A portion of a disc-like shim 51 that closes an end of the extension hole 49 on the side of the closed end of the intake valve lifter 30 is fitted in the cylindrical accommodation portion 50. Further, at a central portion of an inner surface of the closed end of the intake valve lifter 30, a protrusion 52, with which the shim 51 is brought into abutting contact, is integrally formed.

The slide pin 41 is slidably fitted in the sliding hole 45 of the pin holder 39. The hydraulic chamber 40, which is in communication with the annular groove 44, is formed between one of two opposite ends of the slide pin 41 and an inner surface of the intake valve lifter 30. The return spring 42 is disposed in a spring chamber 53 formed between the other end of the slide pin 41 and a closed end of the sliding hole 45.

As shown in FIG. 6, an accommodation hole 54 is formed at an axially middle portion of the slide pin 41. The accommodation hole 54 can be coaxially aligned with the insertion hole 48 and the extension hole 49 such that the end portion of the valve stem 47 can be disposed in the accommodation hole 54. An end of the accommodation hole 54 on the side of the insertion hole 48 opens in a plane contact surface 55 formed in a lower outer surface of the slide pin 41 to be opposed to the insertion hole 48. The contact surface 55 is relatively long in a direction of the axis of the slide pin 41, and the accommodation hole 54 opens in the contact surface 55 at a portion near the hydraulic chamber 40.

The slide pin 41 axially slides in equilibrium state between a hydraulic force acting on an end of the slide pin 41 on the basis of the hydraulic pressure of the hydraulic chamber 40, and the spring force of the return spring 42 acting on the other end of the slide pin 41.

When not operated with the hydraulic pressure of the hydraulic chamber 40 (being hydraulic pressure low), the slide pin 41 is located at a position to displace the accommodation hole 54 from the axes of the insertion hole 48 and the extension hole 49 and to have an end of the valve stem 47 contact the contact surface 55, as shown in FIG. 3.

When operated with the hydraulic pressure of the hydraulic chamber 40 being high, the slide pin 41 moves to the right, as seen in FIG. 3, so that the end portion of the valve stem 47 inserted in the insertion hole 48 is accommodated in the accommodation hole 54 and the extension hole 49.

When the slide pin 41 is moved to a position to have the accommodation hole 54 thereof coaxially align with the insertion hole 48 and the extension hole 49, the intake valve lifter 30 receives a pressing force from the intake camshaft 28 and slides. Accordingly, the pin holder 39 and the slide pin 41 move with the intake valve lifter 30 to the side of the intake valve 20.

However, since merely the end portion of the valve stem 47 is accommodated in the accommodation hole 54 and the extension hole 49, and a pressing force in a valve opening direction does not act on the intake valve 29 from the intake valve lifter 30 and the pin holder 39, the intake valve 20 is held in the suspended state by holding the intake valve 20 in closed position.

When the slide pin 41 is moved to the position to have the contact surface 55 thereof contact with the end portion of the valve stem 47, the intake valve lifter 30 receives the pressing force from the intake camshaft 28 and slides. The pin holder 39 and the slide pin 41 accordingly move to the side of the intake valve 20 to impose a pressing force in the valve opening direction on the intake valve 20. Thus, the intake valve 20 operates or opens and closes in accordance with rotation of the intake camshaft 28.

If the slide pin 41 rotates around its own axis inside the pin holder 39, the axis of the accommodation hole 54 and those of the insertion hole 48 and the extension hole 49 are misaligned. In such situations, it is impossible to have the end portion of the valve stem 47 contact the contact surface 55. The stopper pin 43 is provided in order to inhibit the slide pin 41 from rotating around its own axis to prevent misalignment.

The stopper pin 43 is attached to an attachment hole 56 formed in the bridge portion 39*b* of the pin holder 39 and on the diameter line of the sliding hole 45 such that the stopper pin 43 is disposed coaxially with the bridge portion 39*b* and has an axis parallel to the axis of the intake valve lifter 30.

The stopper pin 43 extends through a slit 57 formed at an end of the slide pin 41 to open into the hydraulic chamber 40. That is, the stopper pin 43 is attached to the pin holder 39 such that the stopper pin 43 extends through the slide pin 41 while allowing movement of the slide pin 41 in an axial direction thereof. A movement of the slide pin 41 to the side of the hydraulic chamber 40 is limited when the stopper pin 43 contacts an inner closed end of the slit 57.

A coil spring 58 is disposed between the pin holder 39 and the cylinder head 14. The coil spring 58 biases the pin holder 39 in a direction to have a shim 51 attached to the pin holder 39 contact with the protrusion 52 disposed in the central portion of the inner surface of the closed end of the intake valve lifter 30. The coil spring 58 surrounds the valve stem 47 at a position where an outer circumferential surface of the coil spring 58 does not contact an inner surface of the valve lifter 30.

A pair of protrusions 59, 59 is integrally formed on the bridge portion 39*b* of the pin holder 39 at an end portion of the coil spring 58 in a direction perpendicular to an axis of the valve stem 47. The protrusions 59, 59 are integrally formed in order to protrude in an amount equal to or smaller than a diameter of a wire of the coil spring 58. Each protrusion 59 has a shape like a circular arc extending around the axis of the valve stem 47. One of the protrusions 59, 59 has a step portion 59*a*. The step portion 59*a* inhibits the stopper pin 43 to the side of the intake valve 20.

The slide pin 41 has a communication hole 60 formed therein. The communication hole 60 communicates with the spring chamber 53 and the accommodation hole 54 in order to prevent an increase and a decrease in a pressure in the spring chamber 53 due to an axial movement of the slide pin 41. The pin holder 39 has a communication hole 61 that communicates in a space between the pin holder 39 and the intake valve lifter 30 with the spring chamber 53 in order to prevent a change in a pressure in the space due to a temperature change.

An annular recess 64 surrounding the intake valve lifter 30 is formed on an inner surface of a support hole 32 formed in the lifter hole plate 14*b* so that the intake valve lifter 30 is slidably fitted and supported in the support hole 32. The intake valve lifter 30 has a communication hole 65 formed therein. The annular recess 64 communicates with the annular groove 44 of the pin holder 39 via the communication hole 65 irrespective of whether the valve lifter 30 slides in the support hole 32. The lifter hole plate 14*b* of the cylinder head 14 includes an intake passage 66 formed therein which communicates with the annular recess 64.

In the exhaust valve lifter 31, a valve pausing mechanism 38 is disposed in a similar way as in the intake valve lifter 30. An exhaust passage 67 is formed in the lifter hole plate 14*b*, which is in communication with an annular recess 64 formed on an inner surface of a support hole 33 formed in the lifter hole plate 14*b* so that the exhaust valve lifter 31 is slidably fitted and supported in the support hole 33.

The hydraulic pressure of the hydraulic chambers 40 of the hydraulically-operated valve pausing mechanisms 38 is controlled by a hydraulic-pressure control device 71 disposed on an upper surface of the head cover 15 to respectively correspond to the two cylinders at the two opposite ends of the line of arrangement of the cylinders.

Referring to FIG. 7, each of the hydraulic-pressure control devices 71 includes a spool valve 72 attached to the upper surface of the head cover 15 and a solenoid valve 73 attached to the spool valve 72.

The spool valve 72 has a valve housing 75 having an inlet port 77 and an outlet port 78 and fastened to the cylinder head 14, and a spool valve body 76 slidably fitted in the valve housing 75.

In the valve housing 75, a bottomed sliding hole 79 is formed through a wall of the valve housing 75 such that the sliding hole 79 is closed at one of two opposite ends thereof and open at the other end. A cap 80 for closing the opening of the sliding hole 79 at the other end is fitted in the valve housing 75. A spring chamber 81 is formed between the spool valve body 76 and the closed end of the sliding hole 79. The spring chamber 81 includes a spring 83 accommodated therein which biases the spool valve body 76 in a direction to decrease an inner volume of a pilot chamber 82.

The inlet port 77 and the outlet port 78 are formed in the valve housing 75 to open in an inner surface of the sliding hole 79 at respective positions spaced from each other in an axial direction of the sliding hole 79. An annular recess 84 on the spool valve body 76 for establishing communication between the inlet port 77 and the outlet port 78. When the spool valve body 76 is moved to a position to minimize the inner volume of the pilot chamber 82, as shown in FIG. 7, the spool valve body 76 is placed in a sate to disconnect the inlet port 77 and the outlet port 78 from each other.

At the inlet port 77, an oil filter 85 is attached. An orifice hole 86 establishing communication between the inlet port 77 and the outlet port 78 is formed through a wall of the valve housing 75. Hence, when the spool valve body 76 is at the position to disconnect the inlet port 77 and the outlet port 78 from each other, as shown in FIG. 7, the inlet port 77 and the outlet port 78 are in communication with each other via the orifice hole 86, flow of a working oil supplied to the inlet port 77 is narrowed at the orifice hole 86 and then proceeds into the outlet port 78.

Further, a release port 87 is formed through a wall of the valve housing 75. The release port 87 communicates with the outlet port 78 via the annular recess 84 only when the spool valve body 76 is located at the position to disconnect the inlet port 77 and the outlet port 78 from each other. The release port 87 opens into the valve chamber 26 between the cylinder head 14A and the head cover 15A.

A passage 88 formed in the valve housing 75 is always in communication with the inlet port 77. The inlet passage 88 is connected to a connection hole 89 via the solenoid valve 73. The connection hole 89 is formed through a wall of the valve housing 75 to be in communication with the pilot chamber 82.

Hence, when the solenoid valve 73 is operated and opened, the hydraulic pressure of the pilot chamber 82 is increased, and the hydraulic pressure increased in the pilot chamber 82 drives the spool valve body 76 in a direction to increase the inner volume of the pilot chamber 82, whereby the inlet port 77 and the outlet port 78 are communicated with each other via the annular recess 84 of the spool valve body 76 while the outlet port 78 and the release port 87 are disconnected from each other.

In the crankcase 11 (refer to FIG. 1) of the engine body 10, an oil pump (not shown) that operates in relation to the crankshaft is accommodated. A working oil from the oil pump is supplied to the inlet port 77 of the hydraulic-pressure control device 71 via an inlet oil channel 90 disposed in the head cover 15. In the head cover 15, an outlet oil channel 91 is disposed such that an end thereof is in communication with the outlet port 78 of the hydraulic-pressure control device 71.

Referring to FIG. 8, a bore 92 formed in the lifter hole plate 14*b* of the cylinder head 14 extends along the line of arrangement of the cylinders at a position between the support holes 32 in which the intake valve lifters 30 are slidably fitted and the support holes 33 in which the exhaust valve lifters 31 are slidably fitted, and near the support holes 32.

One of two opposite ends of the bore 92 opens in one of two opposite lateral sides of the lifter hole plate 14*b* in the direction of the line of arrangement of the cylinders, which side is located at the lowest level while the motorcycle is parked with the side stand S down, that is, in a left end wall of the lifter hole plate 14*b*. The other end of the bore 92 is closed. The opening of the bore 92 at one end thereof is closed by a ball 93.

Pins 94, 94 are press-fitted in the lifter hole plate 14*b* to close the bore 92 at two positions in a middle portion of the bore 92. Thus, an oil passage 95 corresponding to the cylinder on the left end wall of the lifter hole plate 14*b* and an oil passage 96 corresponding to the cylinder on a right end wall of the lifter hole plate 14*b* are formed in the bore 92.

In the lifter hole plate 14*b*, insertion holes 97 are formed to extend through, or to intersect, the oil passages 95, 96. As shown in FIG. 9, bolts 98 are inserted into the insertion holes 97, and the lifter hole plate 14*b* is screwed to the head body

14*a* by means of the bolts 98. An outside diameter of the bolts 98 is set to be smaller than an inside diameter of the bore 92, that is, an inside diameter of the oil passages 95, 96, and thus the bolts 98 do not block the flow of the working oil in the oil passages 95, 96.

At the cylinder at one of two opposite ends of the line of arrangement of the cylinders, the intake passages 66 in communication with the annular recesses 64 of the valve pausing mechanisms 38 for the intake valves 20, and the exhaust passages 67 in communication with the annular recesses 64 of the valve pausing mechanisms 38 for the exhaust valves 21, communicate with the oil passage 95.

At the cylinder disposed at the other end of the line of arrangement of the cylinders, the intake passages 66 in communication with the annular recesses 64 of the valve pausing mechanisms 38 for the intake valves 20, and the exhaust passages 67 in communication with the annular recesses 64 of the valve pausing mechanisms 38 for the exhaust valves 21, communicate with the oil passage 96. The intake passage 66 and the exhaust passage 67 are inclined such that ends of the intake and exhaust passages 66, 67 on the side of the oil passages 95, 96 are located at the highest level in the intake and exhaust passages 66, 67.

Inlet holes 101, 102 are formed in the lifter hole plate 14*b* to open in end portions of the respective oil passages 95, 96, so as to introduce the working oil from the outlet oil channels 91, which are formed in the head cover 15 with their ends communicated with the outlet ports 78 of the hydraulic-pressure control devices 71, into the oil passages 95, 96.

When the solenoid valve 73 of the hydraulic-pressure control device 71 is operated, i.e., opened to establish communication between the inlet port 77 and the outlet port 78, and the hydraulic pressures of the hydraulic chambers 40 of the valve pausing mechanisms 38 are increased to operate the valve pausing mechanisms 38 to place the intake valves 20 and the exhaust valves 21 in the suspended state with the intake valves 20 and the exhaust valves 21 held closed.

When the solenoid valve 73 of the hydraulic-pressure control device 71 is closed, the inlet port 77 and the outlet port 78 are disconnected from each other, and the outlet port 78 is communicated with the release port 87, and thus the hydraulic pressures in the hydraulic chambers 40 are decreased to move the slide pins 41 of the valve pausing mechanisms 38 to the positions to operate or open and close the intake valves 20 and the exhaust valves 21.

Further, air-bleeding holes 99, 100 are formed in the lifter hole plate 14*b*, such that the air-bleeding holes 99, 100 are in communication with portions of the respective oil passages 95, 96 formed in the lifter hole plate 14*b* of the cylinder head 14, located at the highest level in the oil passages 95, 96 when the motorcycle V is parked in an inclined position with its side stand S positioned down.

In other words, air-bleeding holes 99, 100 formed in the cylinder head communicates with a portion of the oil passages 95, 96 located at a highest level in the oil passages 95, 96 when the motorcycle is parked in an inclined state using the parking stand.

While the motorcycle V is parked with its side stand S down in an inclined position, the engine body 10 is inclined to locate one end of each of the oil passage 95, 96 at a lower level. The inlet holes 101, 102 for introducing the working oil from the hydraulic-pressure control devices 71 into the oil passages 95, 96 are formed to open in end portions of the oil passages 95, 96, and the air-bleeding holes 99, 100 are formed in an upper surface of the lifter hole plate 14*b* to open in the other end portions of the oil passages 95, 96.

Next, described below are effects of the illustrative embodiment discussed above.

Since the oil passages 95, 96 introducing the working oil from the hydraulic-pressure control devices 71 controlling the hydraulic pressures of the valve pausing mechanisms 38, into the valve pausing mechanisms 38, are formed in the lifter hole plate 14*b* of the cylinder head 14, and the air-bleeding holes 99, 100 are formed in the lifter hole plate 14*b* to be in communication with the oil passages 95, 96 at the portions located at the highest level in the oil passages 95, 96 when the motorcycle V is parked in an inclined position with the side stand S down, air bleeding can be smoothly performed for the oil passages 95, 96 even while the motorcycle V is parked.

The air-bleeding holes 99, 100 are formed in the lifter hole plate 14*b* to be in communication with end portions of the oil passages 95, 96. If the air-bleeding holes are in communication with a middle portion of the oil passages 95, 96, the air having entered the oil passages 95, 96 tends to flow with the oil. However, the air-bleeding holes 95, 96 of the present invention, as discussed above, are in communication with end portions of the oil passages 95, 96 where the air tends to accumulate, thereby enabling efficient air bleeding.

Since the inlet holes 101, 102 for introducing the working oil from the hydraulic-pressure control devices 71 into the oil passages 95, 96 are formed in the lifter hole plate 14*b* to open in end portions of the oil passages 95, 96, and the air-bleeding holes 99, 100 open in the other end portions of the oil passages 95, 96, the air having entering the oil passages 95, 96 from the end portions of the oil passages 95, 96 is accumulated at the other end portions of the oil passages 95, 96, thereby enabling further efficient air bleeding.

Although only one illustrative embodiment of the present invention has been described above, the invention is not limited thereto, but may be embodied with various design modifications without departing from the invention as defined in the scope of claims.

For example, although the embodiment of the present invention is applied to an inline multicylinder engine, the present invention is applicable to V-type of engines and other possible arrangement of cylinders in the engine.

Although the present invention has been described herein with respect to specific illustrative embodiment(s), the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. A multicylinder engine for a motorcycle, said engine installed on the motorcycle having a parking stand disposed on one side thereof, said multicylinder engine comprising:

a plurality of cylinders;

a cylinder head having an oil passage and an air-bleeding hole formed therein; said air-bleeding hole formed in an upper portion of said cylinder head and operatively connected with said oil passage so as to be in fluid communication therewith, said air-bleeding hole extending upwardly from the oil passage and configured to release air from the oil passage outwardly therethrough and into a valve chamber above said cylinder head;

an intake valve and an exhaust valve disposed in the cylinder head for each of said plurality of cylinders; the intake valve and the exhaust valve being selectively openable and closable during engine operation;

a valve actuation mechanism comprising a hydraulically-operated valve pausing mechanism configured to hold at least one of the intake valve and the exhaust valve of at least one of said plurality of cylinders in a suspended state, wherein said at least one of the intake valve and the exhaust valve is held closed, depending on the operational state of the engine;

a hydraulic-pressure control device for controlling hydraulic pressure of the valve pausing mechanism;

wherein said valve actuation mechanism controls operation of said intake valve and said exhaust valve, and said oil passage is configured and arranged for introducing working oil to the valve pausing mechanism from the hydraulic-pressure control device; and wherein said air-bleeding hole formed in the cylinder head communicates with a portion of the oil passage located at a highest level in the oil passage when the motorcycle is parked in an inclined state using said parking stand.

2. A multicylinder engine according to claim 1, wherein said air-bleeding hole formed in the cylinder head is in fluid communication with an end portion of the oil passage.

3. A multicylinder engine according to claim 1, wherein said cylinder head comprises a lifter hole plate having a plurality of support holes formed therein to slidably receive valve lifters, and also having an inlet hole, said oil passage and said air-bleeding hole formed therein;

wherein said inlet hole introduces the working oil from the hydraulic-pressure control device into the oil passage; and wherein said inlet hole is disposed adjacent to one of two opposite end portions of the oil passage and communicates therewith; and the air-bleeding hole is disposed adjacent to the other end portion of the oil passage and communicates therewith.

4. A multicylinder engine according to claim 2, wherein said cylinder head comprises a lifter hole plate having a plurality of support holes formed therein to slidably receive valve lifters, and also having an inlet hole, said oil passage and said air-bleeding hole formed therein;

wherein said inlet hole introduces the working oil from the hydraulic-pressure control device into the oil passage; and wherein said inlet hole one is disposed adjacent to one of two opposite end portions of the oil passage and communicates therewith and the air-bleeding hole is disposed adjacent to the other end portion of the oil passage and communicates therewith.

5. A multicylinder engine according to claim 1, wherein said one side is a left side in a transverse direction of the motorcycle.

6. An engine for a motorcycle, said engine comprising:

a plurality of in-line cylinders;

a cylinder head having a cylinder head body and a lifter hole plate connected to the cylinder head body; said lifter hole plate having a plurality of support holes formed therein to slidably receive valve lifters, and also having an oil passage and an air-bleeding hole formed therein; said air-bleeding hole formed in an upper portion of said lifter hole plate and being operatively connected with said oil passage so as to be in fluid communication therewith, said air-bleeding hole extending upwardly from the oil passage and configured to release air from the oil passage outwardly therethrough and into a valve chamber above said lifter hole plate;

an intake valve and an exhaust valve disposed in the cylinder head for each of said plurality of cylinders;

a hydraulically-operated valve pausing device which is operable to hold at least one of the intake valve and the exhaust valve of a selective one of said plurality of cylinders in a suspended state by closing said at least one of the intake valve and the exhaust valve; and a hydraulic-pressure control device for controlling hydraulic pressure of the valve pausing device;

wherein said oil passage is operatively connected to the valve pausing mechanism and supplies oil thereto; and wherein said air-bleeding hole communicate with portion of the oil passage located at a highest level in the oil passage when the engine is tilted on one side in a transverse direction thereof of the motorcycle.

7. An engine for a motorcycle according to claim 6, wherein said transverse direction extends from left side to right side when the engine is mounted on said motorcycle.

8. An engine for a motorcycle according to claim 6, wherein the air-bleeding hole formed in the lifter hole plate fluidly communicates with an end portion of the oil passage.

9. An engine for a motorcycle according to claim 6, wherein said lifter hole plate further has an inlet hole formed therein;

wherein said inlet hole introduces the working oil from the hydraulic-pressure control device into the oil passage; and wherein said inlet hole fluidly communicates with one of two opposite end portions of the oil passage and the air-bleeding hole fluidly communicates with the other end portion of the oil passage.

10. An engine for a motorcycle according to claim 8, wherein said lifter hole plate further has an inlet hole formed therein;

wherein said inlet hole introduces the working oil from the hydraulic-pressure control device into the oil passage; and wherein said inlet hole fluidly communicates with one of two opposite end portions of the oil passage; and said air-bleeding hole fluidly communicates with the other end portion of the oil passage.

11. An engine for a motorcycle according to claim 6, wherein said plurality of in-line cylinders is four; and wherein said selective one of said plurality of cylinders which are suspended include two cylinders at two opposite ends of the in-line cylinders.

12. A motorcycle comprising an engine and a parking stand adapted to park the motorcycle in an inclined position in a transverse direction thereof;

said engine comprising:

a cylinder block having a plurality of cylinders arranged in the transverse direction of the motorcycle;

a cylinder head connected to the cylinder block; said cylinder head having an oil passage and an air-bleeding hole formed therein; said air-bleeding hole being formed in an upper portion of said cylinder head and fluidly connected with said oil passage, said air-bleeding hole extending upwardly from the oil passage and configured to release air from the oil passage outwardly therethrough and into a valve chamber above said cylinder head;

an intake valve and an exhaust valve disposed in the cylinder head for each of said plurality of cylinders;

a hydraulically-operated valve pausing device configured to hold at least one of the intake valve and the exhaust valve of a selective one of said plurality of cylinders in a suspended state to suspend operation of said selective one of said plurality of cylinders;

a hydraulic-pressure control device for controlling hydraulic pressure of the valve pausing device;

wherein said oil passage is operatively connected to the valve pausing mechanism and supplies oil thereto via said a hydraulic-pressure control device; and wherein said air-bleeding hole communicates with a portion of the oil passage located at a highest level in the oil passage when said engine is tilted while the motorcycle is parked leaning on one side in the transverse direction using the parking stand.

13. A motorcycle according to claim 12, wherein said one side is a left side.

14. A motorcycle according to claim 12, wherein said one side is a right side.

15. A motorcycle according to claim 12, wherein said air-bleeding hole fluidly communicates with an end portion of the oil passage.

16. A motorcycle according to claim 12, wherein said cylinder head comprises a lifter hole plate having a plurality of support holes formed therein to slidably receive valve lifters, and also having said oil passage and said air-bleeding hole formed therein.

17. A motorcycle according to claim 12, wherein said cylinder head comprises a lifter hole plate having an inlet hole, a plurality of support holes formed therein to slidably receive valve lifters, and also having said oil passage and said air-bleeding hole formed therein;

wherein said inlet hole introduces the working oil from the hydraulic-pressure control device into the oil passage; and wherein said inlet hole fluidly communicates with one of two opposite end portions of the oil passage and the air-bleeding hole fluidly communicates with the other end portion of the oil passage.

18. A motorcycle according to claim 12, wherein said cylinder head comprises a lifter hole plate having a plurality of support holes formed therein to slidably receive valve lifters, and also having said oil passage and said air-bleeding hole formed therein; and wherein said lifter hole plate extends in said transverse direction of the motorcycle.

19. A motorcycle according to claim 15, wherein said cylinder head comprises a lifter hole plate having a plurality of support holes formed therein to slidably receive valve lifters, and also having an inlet hole, said oil passage and said air-bleeding hole formed therein;

wherein said inlet hole introduces the working oil from the hydraulic-pressure control device into the oil passage; and wherein said inlet hole fluidly communicates with one of two opposite end portions of the oil passage and the air-bleeding hole fluidly communicates with the other end portion of the oil passage.

20. A motorcycle according to claim 19, wherein said lifter hole plate extends in said transverse direction.

* * * * *